US006646626B1

(12) United States Patent
Uskali et al.

(10) Patent No.: US 6,646,626 B1
(45) Date of Patent: Nov. 11, 2003

(54) METHOD AND APPARATUS FOR AUTOMATIC VIEWING ANGLE ADJUSTMENT FOR LIQUID CRYSTAL DISPLAY

(75) Inventors: Robert G. Uskali, Schaumburg, IL (US); Roger W. Ady, Chicago, IL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 09/431,660

(22) Filed: Nov. 1, 1999

(51) Int. Cl.[7] ..... G09G 3/36
(52) U.S. Cl. ..... 345/87
(58) Field of Search ..... 345/87, 88, 90, 345/95, 96, 97, 100, 649, 650, 656, 658, 659; 379/433.13, 433.04, 447; 455/90, 575

(56) References Cited

U.S. PATENT DOCUMENTS 4,832,454 A * 5/1989 Walters ..... 345/38
5,402,152 A * 3/1995 Needham ..... 345/179
5,534,889 A * 7/1996 Reents et al. ..... 345/132
5,656,804 A * 8/1997 Barkan et al. ..... 235/472.01
5,731,801 A * 3/1998 Fukuzaki ..... 345/146
5,841,425 A * 11/1998 Zenz, Sr. ..... 345/163
5,898,758 A * 4/1999 Rosenberg ..... 379/433

* cited by examiner

*Primary Examiner*—Richard Hjerpe
*Assistant Examiner*—Ronald Laneau
(74) *Attorney, Agent, or Firm*—Romi Bose; Hisashi D. Watanabe

(57) ABSTRACT

An apparatus (10) for automatically adjusting the viewing angle of a liquid crystal display (LCD) (12) is provided. The apparatus (10) includes a controller (26), an LCD driver (28), a memory (30), and a user interface (34). The apparatus (10) is software enabled to perform a screen flip function while concurrently adjusting the viewing angle to correspond to the new screen orientation. The viewing angle is automatically adjusted without user intervention. The apparatus (10) has particular value where the keypads (22) are located on only one side of its display (12). In this manner, the apparatus (10) can be conveniently used by both left-handed and right-handed users.

6 Claims, 10 Drawing Sheets

METHOD AND APPARATUS FOR AUTOMATIC VIEWING ANGLE ADJUSTMENT FOR LIQUID CRYSTAL DISPLAY

FIELD OF THE INVENTION

The invention relates to liquid crystal displays and, more particularly, to a liquid crystal display for a hand-held apparatus that is adapted for use in different orientations.

BACKGROUND OF THE INVENTION

The explosion in the use of hand-held electronic devices, such as organizers, pagers and cellular telephones including liquid crystal displays (LCDs) to provide text and/or graphical output to the user, has been dramatic in recent years. LCDs are desirable because of their small size and weight and low power requirements which makes them ideal for use with hand-held electronic devices. LCDs are also capable of displaying different types of images, such as characters, graphics, captured images, such as photographs, or the like. Many LCDs are reflective, meaning that they use only ambient light to illuminate the display. Others require an external light source such as a back lit computer display screen.

LCDs do have drawbacks, such as with respect to their viewing angle. The viewing angle of an LCD defines the field of view in which a user can see characters or images displayed by the LCD, relative to the display surface of the LCD. With conventional LCDs, the viewing angle is limited, and thus, characters or images on these LCDs are not visible from all possible views. Moreover, items displayed on LCDs normally exhibit asymmetrical visibility, which means that the visibility of a character or image depends not only on the angle at which the LCD is viewed, but also depends on the direction at which the LCD is viewed. The viewing angle and contrast setting of an LCD are closely related and both are controlled by a drive voltage applied to the LCD. As the applied drive voltage changes, so does the viewing angle of the LCD. Each different LCD viewing angle is associated with a different viewing angle cone for the user so that depending on the relative position of the user and LCD, there is a particular voltage that produces an optimum LCD viewing angle for providing a viewing angle cone for the user that maximizes the visibility of the characters on the screen.

Typically, a user adjustment is provided such as by a knob that controls a potentiometer or variable resistor of a contrast adjustment circuit for the LCD. Accordingly, manual operation of the control knob adjusts the drive voltage applied to the LCD for adjusting the viewing angle thereof. Other types of user/operator interfaces also are known such as with control keys for operating Windows or icon based software programs that allow for a contrast adjustment mode to be selected. In the contrast adjustment mode, different contrast settings can be selected according to user preferences. In this manner, different levels of drive voltage and thus viewing angles can be keyed into the device for changing the viewing angle of the LCD under microprocessor control. However, where the device is consistently disposed in orientations that are different but predictable relative to the user, it is undesirable to have to continually adjust the contrast setting to obtain the appropriate viewing angle for the LCD. This occurs with hand-held electronic devices that are used by both right and left-handed people, for instance.

For example, clip-on type organizers are known that can be attached to the back of a cellular telephone so that the information stored in the organizer can be shared with and/or used by the phone such as for allowing one-touch calling of a number stored in the organizer. Where the keys are asymmetrically arranged on the organizer, i.e., on one side or the other of the LCD, the user can be at a disadvantage depending on which hand they tend to hold the phone with. For instance, where the keys are arranged on the right-hand side of the LCD for use by right-handed users with the phone held in the left hand and generally facing downwardly so that the organizer LCD can be viewed, the characters are in their standard, upright readable position on the screen. However, with a left-handed user who tends to hold the phone in their right hand to keep their left hand free for punching the keys on the phone and organizer, when they turn the phone so that it faces downwardly for viewing the LCD of the organizer clipped onto the back of the phone, the keys will now be on the left hand side of the LCD with the characters appearing inverted from their standard, upright readable position. To accommodate both right and left-handed users, the orientation of the characters can be shifted or rotated 180° so that when the left-handed user views the LCD, the characters will appear in their standard, upright readable position thereon.

It is also true that the organizer LCD screen will generally be at a different orientation relative to the user depending on whether they hold the organizer in their right or left hand with the keys accessible to their free strong hand. At different orientations, the visibility of the LCD display can vary greatly because the orientations can entail different viewing angles and different viewing directions. This can be a serious problem where both right and left-handed people use the same phone and organizer, or where the phone and organizer are regularly held in either hand, during operation or when the organizer is detached due to the configuration of the phone antenna or flipped-open portion of the phone. Thus, each time a user holds the phone with the hand opposite to the one previously used, employed or where a single user uses different hands for holding the organizer alone versus when it is clipped to the phone, an adjustment will have to be made to the contrast setting and viewing angle to accommodate for the different orientations of the screen.

Accordingly, there is a need for a hand-held electronic device that allows it to be used when held in either the right or left hand of a user while keeping the visibility of the images on the LCD maximized. More particularly, a hand-held electronic device that includes keys asymmetrically arranged relative to an LCD screen thereon, and where the characters on the screen can be shifted and rotated so that they can be read in their upright position by both right and left-handed users of the device, is needed where the viewing angle of the LCD is automatically adjusted to accommodate both right and left-handed users without requiring manual adjustments to the contrast setting.

DETAILED DESCRIPTION OF THE PREFERRED EMBODIMENTS

It is an advantage of the present invention to provide an apparatus that automatically adjusts the LCD drive voltage of an electronic display to accommodate a predetermined rotation of the display. In adjusting the LCD drive voltage, the apparatus can also account for a preselected contrast setting determined by a user.

The apparatus can include an LCD, an LCD driver, a user interface, and a controller. The user interface permits a user to select a predetermined orientation of the LCD. In response to the user input, the controller directs the LCD driver to apply a drive voltage to the LCD. The drive voltage can be determined so that optimized visibility of the display is maintained despite shifting of the LCD predetermined orientation. Further, this drive voltage determination takes into account user adjustments made to the contrast setting for optimal viewing in one substantially predetermined orientation of the LCD when shifted to another substantially predetermined LCD orientation.

This arrangement permits hand-held electronic devices having keypads located asymmetrically relative to the LCD such as on one side thereof to be easily operated by either right-handed or left-handed users.

Figure 1:
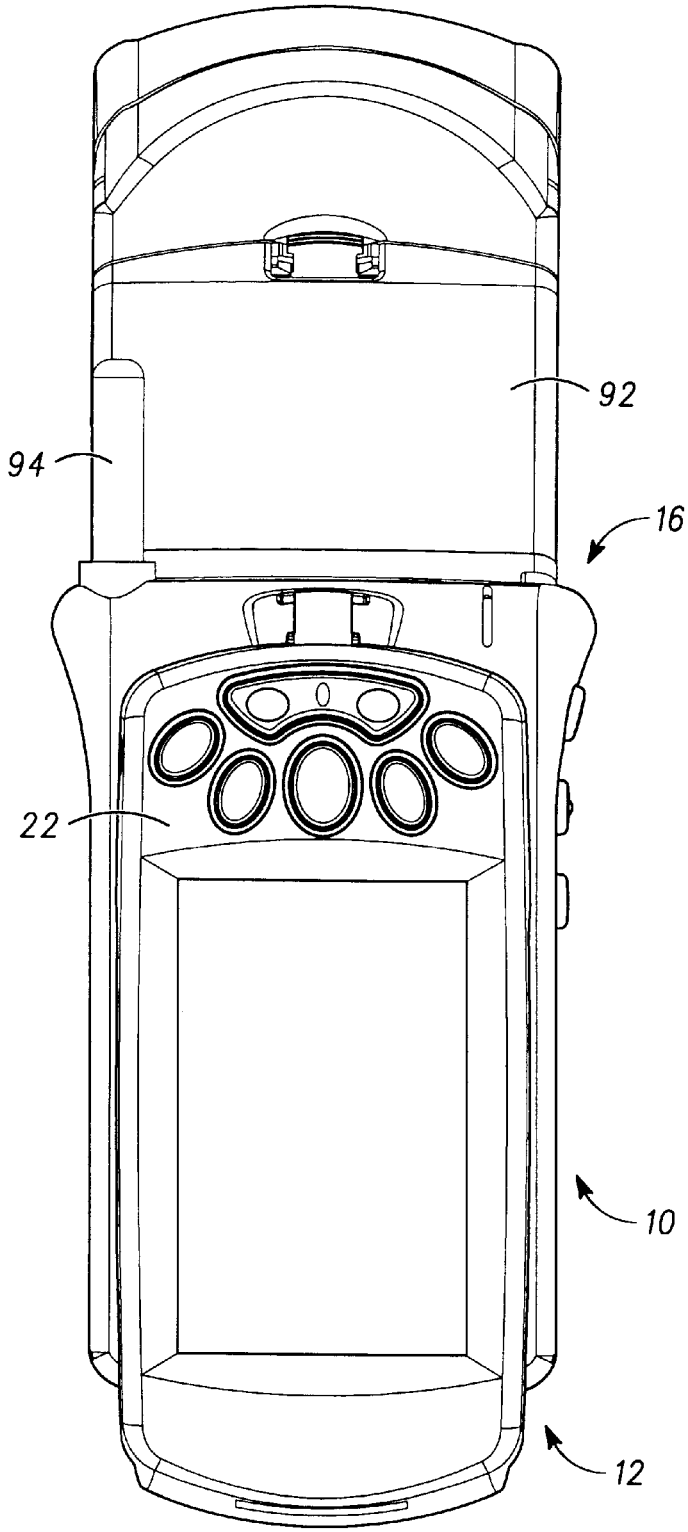
FIG. 1 is a plan view of an apparatus in accordance with the present invention in the form of an organizer showing a housing of the organizer including an LCD and input keys mounted to one side of the LCD and removably attached to another hand-held electronic device in the form of a cellular telephone.

In FIG. 1, an apparatus 10 is shown including a screen 12 for displaying information to a user thereof via indicia or characters 14 in the form of text and/or graphical images thereon. As shown, the apparatus 10 is removably attached to a hand-held electronic device 16 which can use and/or share the information displayed on the screen 12 in its operation. The apparatus 10 can be used by itself or in conjunction with the device 16. In this regard, the apparatus 10 and device 16 are provided with a detachable electronic connection 18 therebetween, as will be discussed more fully hereinafter.

The apparatus 10 includes a small, lightweight housing 20 so as to be readily portable by a user from one location to another without taking up much space. In this regard, the screen 12 of the apparatus 10 is an LCD screen 12 mounted to the housing 20 which enables the overall size and weight of the apparatus 10 to be kept to a minimum. Input keys, generally designated 22, are provided on the housing 20 arranged to one side of the LCD 12. For both left and right-handed users to operate the keys 22 without having to reach across the LCD screen 12 with their strong hand, a screen flipping function is incorporated into software programming of control circuitry 24 for the apparatus 10 and the LCD 12 thereof, with the circuitry 24 being disposed in the housing 20 of the apparatus 10.

In this regard, the apparatus 10 utilizes a programmable microprocessor controller 26 that is programmed with the screen flipping function and to automatically adjust the viewing angle, θ, of the LCD 12, as described herein.

Figure 5:
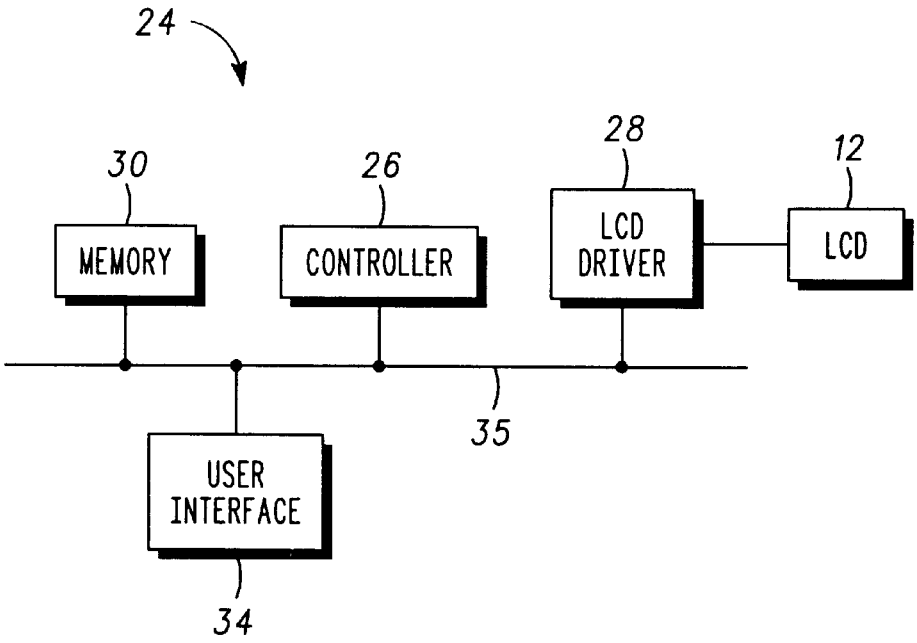
FIG. 5 is a block diagram of control circuitry for the LCD showing a programmable controller which automatically adjusts the drive voltage applied to the LCD when a screen flip switch is operated to reorient the image displayed on the LCD.

More particularly and with reference to FIG. 5, the circuitry 24 includes a controller 26, a memory 30, a user interface 34 and an LCD driver 28. A bus 35 couples and permits communication between the above-listed components. The LCD driver 28 can supply row and column drive signals, as well as drive voltage levels, to an LCD 12.

The controller 26 can be a 6800 series microprocessor from Motorola, Inc., executing one or more software routines to perform the functions of the circuitry 24 as described herein. The software routines can be stored in an internal memory (not shown) of the controller 26 or the memory 30.

The memory 30 can be non-volatile memory, such as read-only memory (ROM), programmable read-only memory (PROM), an electrically-erasable PROM (EEPROM), or the like. The memory 30 can store program instructions and data, such as user selected settings, predetermined offset drive voltage values, and LCD drive voltage values.

The user interface 34 can be any means for permitting users to select or input commands and data into the apparatus 10. The interface 34 can include the conventional push-button keys 22 for generating interrupts that cause the controller 26 to execute one or more predetermined software routines for gathering user inputs. In addition, the interface can include conventional potentiometers for setting LCD screen display characteristics, such as contrast, brightness, or the like. Alternatively, as described below in connection with FIG. 4, the user interface 34 can include a keypad used in conjunction with a graphical user interface (GUI) having scrollable menus that permit users to select various operational settings for the apparatus 10.

The LCD driver 28 can be any electronic circuit responsive to the controller 26 for generating an LCD drive voltage in accordance with the present invention. For example, the LCD driver 28 can be implemented using an LCD Segment/Common Driver, Part No. MC 141800A, from Motorola, Inc.

The bus 35 can use a conventional bus protocol, such as one available with 6800 series processors, for transferring data, commands and control signals between the components connected thereto.

The circuit structure shown in FIG. 5 is exemplary, and it should be noted that many alternative, equivalent architectures are possible for implementing the present invention. For example, the circuitry 24 can be equivalently implemented using custom circuits, such as one or more application specific integrated circuits (ASICs), or alternative types of microprocessors and LCD drivers that are commercially available and capable of being configured to function in accordance with the invention.

Figure 14:
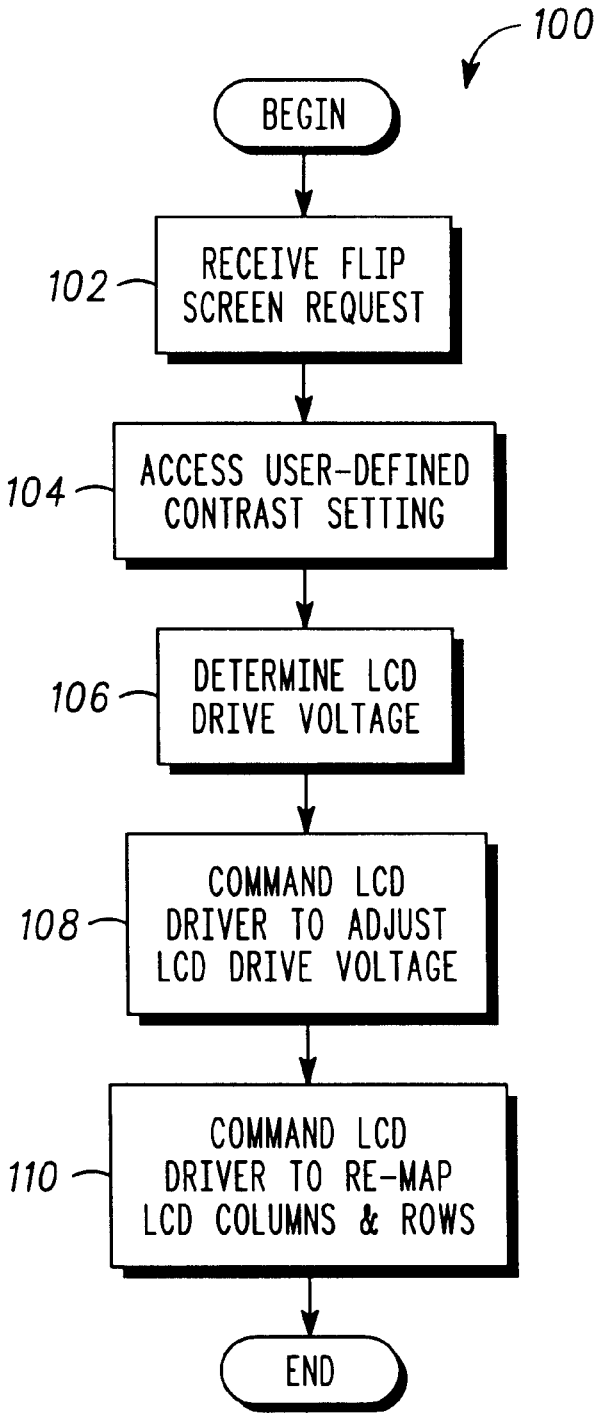
FIG. 14 shows a flow chart diagram illustrating a method of operating the control circuitry shown in FIG. 5.

Referring now to FIG. 14, there is shown an exemplary method 100 of operating the circuit 24 in accordance with the present invention. In step 102, a user request to perform the screen flipping function is received at the user interface 34. As described below in greater detail, the screen flipping function essentially rotates the items displayed on the LCD 180° about the LCD screen. In addition to flipping the screen, the circuitry 24 can adjust the LCD drive voltage to approximately adjust the viewing angle for each screen flip.

Upon receiving the flip screen request, the controller 26 is alerted to the request. In response, the controller 26 can access the memory 30 to retrieve a preselected user-defined contrast setting entered via the user interface 34, as described in connection with FIG. 4. Next, in step 106, the controller 26 computes a drive voltage value by adding or subtracting an LCD voltage offset value to the retrieved contrast setting value. Alternatively, the drive voltage can be retrieved from a look-up table stored in the memory 30. In using a look-up table, the offset value and user contrast setting can be combined so that they may be used as look-up table address.

In step 108, the controller 26 can command the LCD driver 28 to adjust its output LCD drive voltage according to the LCD drive level computed or retrieved by the controller 26.

Next, in step 110, the controller 26 can command the LCD driver 28 to re-map the LCD rows and columns in order to flip the screen by 180°. In the implementation using Motorola Part No. 141800A, the screen flip can be accomplished by the controller 26 issuing a re-map column command to the driver 28, followed by a re-map row command.

The controller 26 controls the LCD drive voltage drive, V, which is generated by the LCD driver 28 for driving the LCD 12 under program control. A value representing an initial LCD drive voltage can be stored by the controller 26 in the memory 30 so that it can be retrieved by the controller 26 when the apparatus 10 is turned on. In some instances, the stored drive voltage level can be overwritten in the memory 30 by a particular contrast setting selected by a user via the user interface 34.

Figure 2:
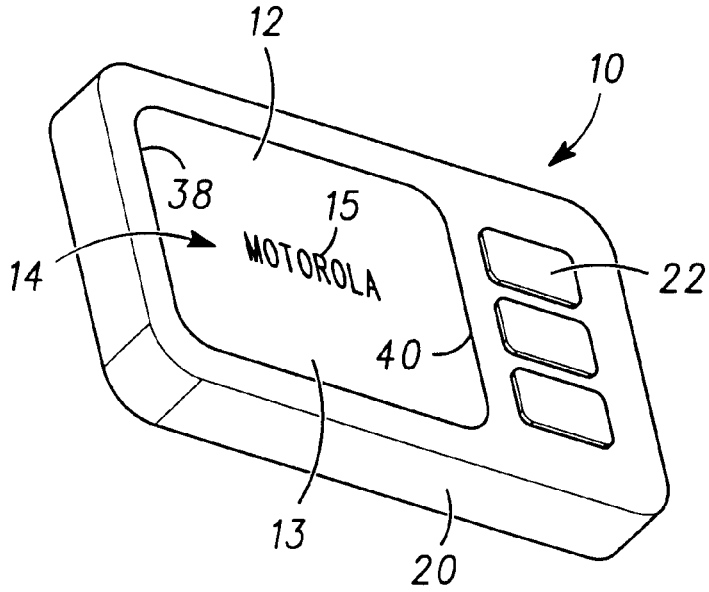
FIG. 2 is a perspective view of the organizer detached from the cellular telephone showing characters displayed on the LCD in a predetermined orientation relative to the keys for right-handed users of the organizer.

Accordingly, the user interface 34 includes a screen flip switch which when operated causes the controller 26 via its programming to undertake the character reorientation so that the characters 14 are shifted from the predetermined orientation currently being displayed on the screen 12. More specifically, the character reorientation involves orienting the characters 12 so that they can be read in their standard, upright position when the housing 20 is held with the input keys 22 oriented on the right side of the screen 12 as when a right hand user is holding the apparatus 10 with their left hand, leaving their right hand free to operate the keys 22, as shown in FIG. 2, or to the position of FIG. 3 where the housing 20 is rotated 180° relative to the user with the keys 22 now on the left hand side of the screen 12 so that with a left-hand user holding the housing 20 with their right hand, their left hand is free to access the keys 22 without obstructing their view of the screen 12.

Figure 3:
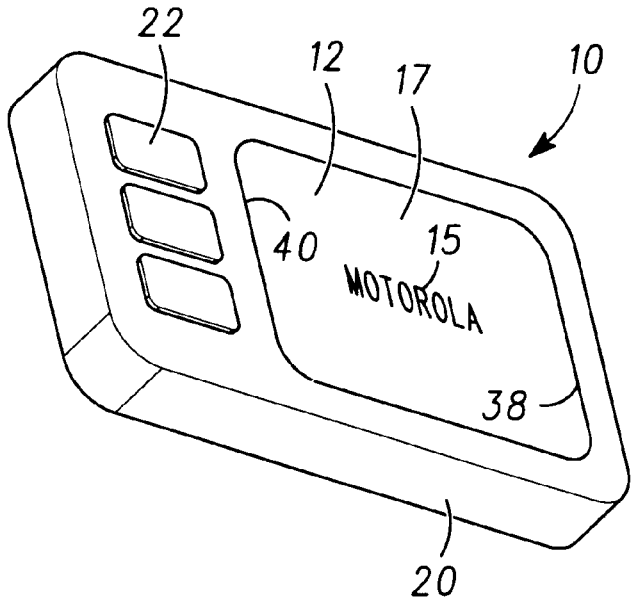
FIG. 3 is a view similar to FIG. 2 with the housing rotated 180° for use by left-handed users so that the keys are now disposed on the left-hand side of the LCD and the characters are rotated 180° relative to their orientation depicted in FIG. 2.

The LCD screen 12 has opposite sides 38 and 40. With the screen flip switch operated so that the characters 14 appearing on the LCD screen 12 are in their upright, standard readable position relative to the user with the input keys 22 accessible for a right-hand user, the character "M" designated 15 will appear on screen half portion 13 and be closer to side 38 of the screen 12 than side 40 as shown in FIG. 2. On the other hand, when the screen flip switch is operated so that a left-handed user can hold the housing 20 with their right hand flipped 180° from its FIG. 2 position with the keys 22 accessible to their free left hand, the character 15 also will be shifted or rotated by 180° from its position of FIG. 2 so that it now appears on the other half portion 17 of the screen 12 flipped over so as to be in its standard, upright readable position closer to side 40 of the screen 12 than side 38, as shown in FIG. 3.

In accordance with the invention, at the same time the screen flip switch is actuated by a user, the controller 26 is programmed to determine an offset voltage. The offset voltage can be combined with the selected contrast setting stored in the memory 30 for being applied to the LCD 12. In this manner, the screen 12, although held in different orientations relative to the user, as shown in FIGS. 2 and 3, will have the characters 14 appearing thereon automatically maximized in visibility. This is because the adjusted voltage will automatically compensate for the reorientation of the screen 12 when the housing 20 is reoriented from one of the FIG. 2 and FIG. 3 positions to the other position. Thus, the visibility of the characters 14 in both of their upright positions relative to the user is automatically maximized irrespective of whether the housing 20 and thus the screen 12 mounted thereon is in the FIG. 2 or the FIG. 3 position in the apparatus 10 herein. Accordingly, the apparatus 10 herein includes circuitry where a portion thereof is for automatically adjusting the LCD drive voltage and thus its viewing angle as an incidence of the reorientation of the characters 14 on the LCD screen 12.

The visibility of the information displayed by the LCD 12 to a user at a particular location relative to the screen 12 depends on the LCD viewing angle, θ, which is generated by the LCD drive voltage, V, with which the display 12 is driven. As described, the operation of the screen flip switch adjusts the LCD drive voltage, V, to maximize visibility of the characters 14, whether in the right-hand use mode of FIG. 2 or left-hand use mode of FIG. 3. In this regard, it is assumed users will tend to utilize the apparatus 10 so that they will generally consistently be in the same reference position relative to the apparatus 10 whether held in their right hand (FIG. 2) or left hand (FIG. 3). It is also generally true that a user will not be looking straight on at the screen 12 so that their line of sight is normal thereto along line 43 as the apparatus 10 will typically be held at a slight angle therefrom. Thus, the particular hand in which the housing 20 is held by the user will make a difference as to the orientation of the screen 12 relative to the user since the housing 20 is flipped 180° between the FIG. 2 position where screen half portion 13 is closer to the user and the FIG. 3 position where screen half portion 17 is now closer. This change in the screen orientation necessitates a change in the LCD viewing angle, θ, and thus viewing cone to keep the characters 14 maximized in visibility to the user.

Figure 6:
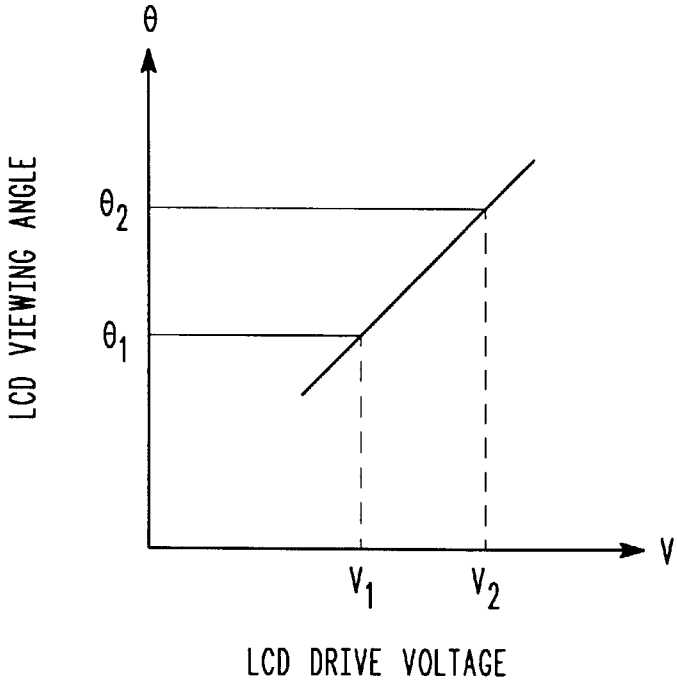
FIG. 6 is a graph depicting the relationship of the LCD viewing angle, θ, to the LCD drive voltage, V.
Figure 7:
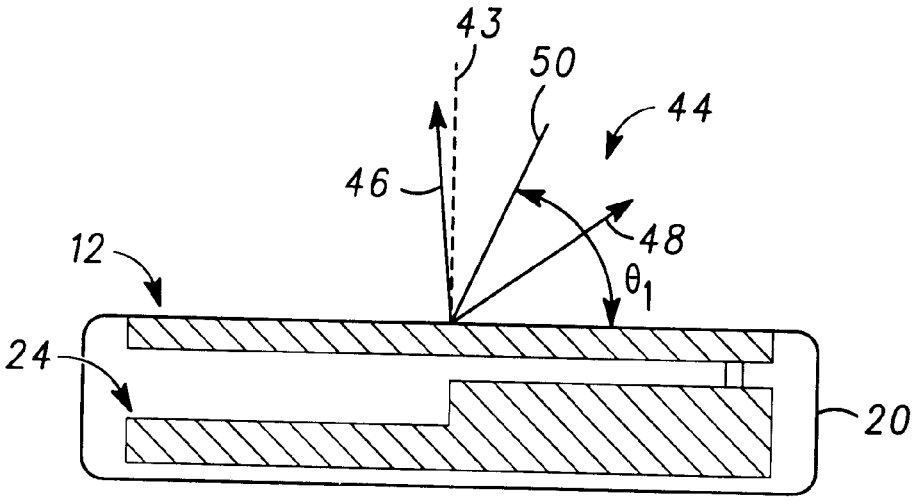
FIG. 7 is an elevation view of the LCD showing a first LCD viewing angle, $\theta_1$, and a user viewing angle cone associated therewith.
Figure 8:
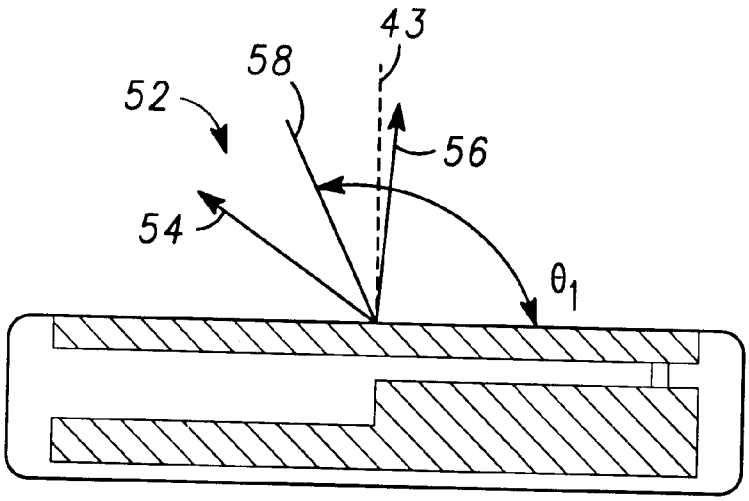
FIG. 8 is an elevation view similar to FIG. 7 showing a second LCD viewing angle, $\theta_2$, and a user viewing angle cone associated therewith.

As can be seen in FIG. 6, the LCD viewing angle, θ, becomes larger as the drive voltage, V, increases. Each LCD viewing angle, θ, generates a different viewing angle cone for the user in which the line of sight from the user to the screen 12 should fall for maximum visibility of the characters 14 thereon. This viewing angle cone is generally bisected by the line defining the LCD viewing angle, θ, with the plane of the screen 12, as can be seen in FIGS. 7 and 8.

With the above in mind, the apparatus 24 can operate in conformity with the preferred form of the present invention as follows. When the user initiates a screen flip via interface 34, the controller 26 generates the characters 14 in an orientation that is shifted or rotated 180° from the prior orientation, as previously described. Coincident with this change, the user then physically repositions the apparatus 10 so that the viewing angle, θ, obtained by the contrast ratio previously set optimally by the user is no longer optimal. In order to maintain the user preset viewing angle, θ, stored contrast setting is offset automatically by a determination made under control of the microprocessor 26. Referring to FIGS. 7 and 8, the voltage offset, Vo, can be determined by way of the equation:

$$\theta_1+\theta_2=\theta\max.$$

As a general characteristic, LCDs have a known maximum viewing angle, θmax, based on their particular construction. The range of LCD viewing angles, θ, limited by θmax provided by the LCD 12 is assumed to be 180° herein, but can be other values without significantly affecting the operation of the apparatus 10 in accordance with the present invention as described herein. Further, the current drive voltages, either $V_1$, or $V_2$ which generates $\theta_1$ or $\theta_2$, respectively, can also be known as they can be stored in the memory 30 of the control circuitry 24. Accordingly, the circuitry 24 can make use of a relatively simple calculation that allows the controller 26 to determine the drive voltage, V, to be generated by the driver 28 for driving the LCD 12 to generate the appropriate LCD viewing angle, θ, thereof to satisfy the above equation. As is apparent, the voltage offset, Vo, can be positive or negative and may be either obtained from a calculation or can be predetermined based on the particular characteristics of the LCD used in the apparatus 10. One or more offset values can be stored in a look-up table contained in the memory 30. By storing offsets corresponding to different LCDs, the circuitry 24 can be easily reconfigured in software to adapt to the characteristics of LCDs from different manufacturers. In this manner, the apparatus 10 can be implemented and manufactured with a minimum of expense, as it does not require any further hardware for the apparatus 10 that is not already provided for performing with the screen flip function.

To complete the screen flip process, the controller 26 adjusts the LCD drive voltage, V, and stores this setting in the memory 30 for later use. Upon request for another display flip, the entire process can be repeated. A voltage offset adjustment is made to a user preferred contrast setting rather than an absolute setting so that the circuitry 24 operates to maintain any user inputted contrast setting. In addition, the voltage offset can be combined with a predetermined drive LCD drive voltage selected to compensate for temperature in order to arrive at an optimal LCD drive voltage.

As earlier noted, the LCD screen 12 itself may not be capable of providing a large enough range of viewing angle adjustments (θmax<180°) to maintain the relationship $\theta_1+\theta_2=180°$. The circuitry 24 is still operable with an LCD that is limited to less than 180° in its viewing angle range as the determination 42 will use the maximum LCD viewing angle, θmax, and thus make the best case automatic adjustment instead. Accordingly, the circuitry 24 described herein generally can allow the user to avoid having to make a manual contrast adjustment each time the screen flip switch 34 is operated.

Referring to FIGS. 6, 7 and 8, the relationship of the viewing angles $\theta_1+\theta_2$, the LCD drive voltages, $V_1$ and $V_2$, and associated viewing angle cones 44 and 52 can be seen. In this instance, it is assumed that the LCD 12 can provide the entire 180° range of viewing angle adjustments for maintaining the relationship of $\theta_1+\theta_2=180°$, so that $\theta_1$ and $\theta_2$ are supplementary angles to each other. With LCD viewing angle, $\theta_1$, it is assumed that the user has already adjusted the contrast setting by way of input keys 22, as will be more fully described hereinafter, so that the drive voltage, $V_1$, provides the viewing cone 44 preferred by the user as shown in FIG. 7. The viewing cone 44 is defined by the vectors 46 and 48 which, in turn, are bisected by the line 50 that defines the LCD viewing angle, $\theta_1$, in conjunction with the plane of the LCD display 12.

When the screen flip switch is operated, the controller 26 determines the offset drive voltage, Vo, via circuitry portion 24 from the voltage, $V_1$, that generates LCD viewing angle, $\theta_1$, and viewing cone 44. The controller 26 regulates the power to the LCD driver 28 so that drive voltage, $V_2$, is applied to the display 12 for shifting the viewing angle, θ, from $\theta_1$ to $\theta_2$. In the described LCD 42 having θmax=180°, this will change the viewing cone 44 symmetrically about axis 43 to viewing cone 52, which is defined by vectors 54 and 56. The viewing cone 52 is bisected by line 58 which together with the plane of the LCD 12 defines the LCD viewing angle, θ2.

As is apparent, the viewing angle cones 44 and 52 are shifted from one another to accommodate the changing orientation of the housing 20 between the FIG. 2 and FIG. 3 positions thereof. Accordingly, one of the viewing cones 44 or 52 will be used when screen half portion 13 is closer to the user (FIG. 2) and the other of cones 44 and 52 will be used when screen half portion 17 is closer to the user (FIG. 3)so that with a user at a single reference position, their line of sight to the LCD 12 will fall within the cone 44 or 52 that is in effect thus maximizing the visibility of the characters 14 appearing on the LCD 12. This automatic changeover between cones 44 and 52 enables screen flipping via interface or switch 34 with automated contrast adjustment so as to avoid the need to make changes to the settings when one screen portion 13 or 17 is shifted from being furthest from the user to closest.

In addition, the user can adjust the cones 44 and/or 52 to their preferences via user interface 34 and the program will automatically correct the other of the cones 44 or 52 so that it too will be at the preference adjustment made by the user for maximum visibility. This is because the controller 26 bases the determination of the offset voltage, $V_0$, from the adjusted voltage $V_1$ or $V_2$ stored in memory 30 so that this adjustment is worked into the automatic adjustment made to generate the other cone when the screen orientation is changed. Accordingly, the offset voltage, $V_0$, is variable and determined by the controller 26 based on a user preferred viewing cone such as cones 44 or 52.

Figure 12:
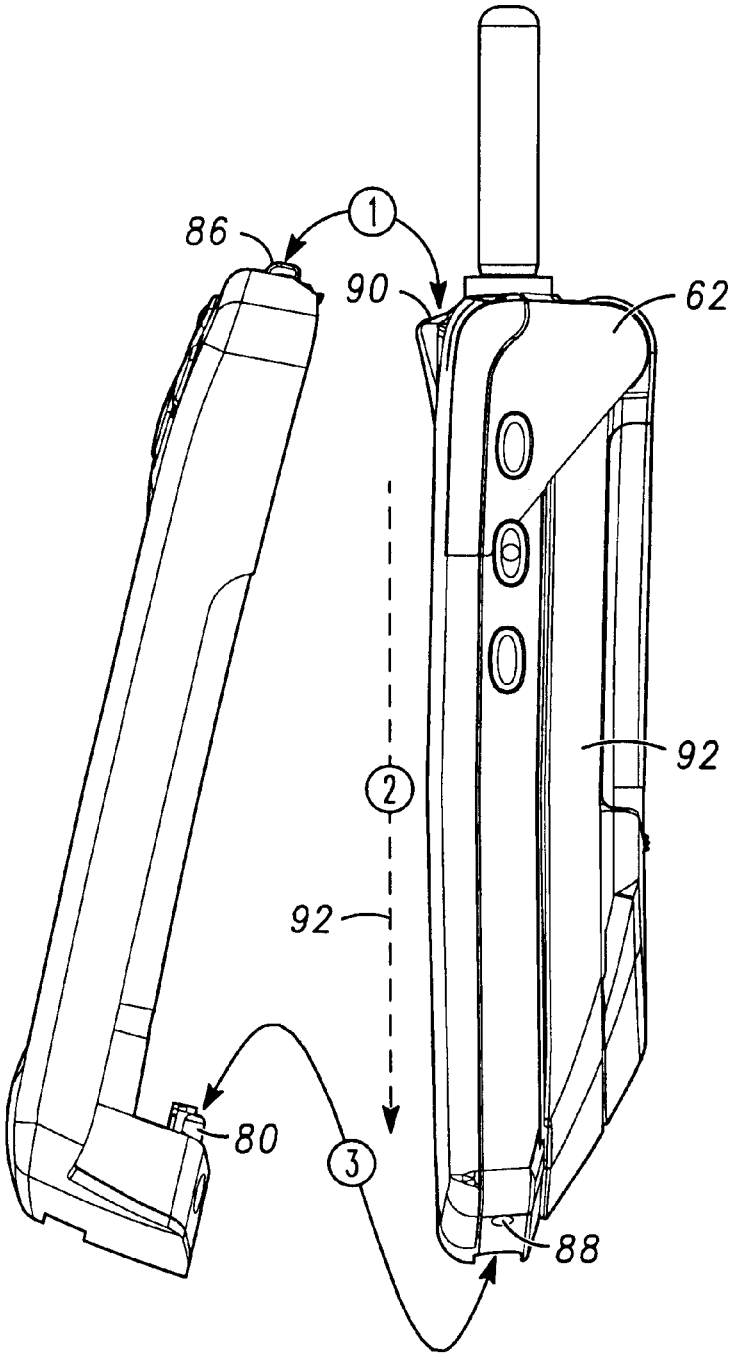
FIG. 12 is an elevational view showing the attachment of the organizer to the cellular phone.

In the preferred and illustrated form, the apparatus 10 is shown as being a battery powered organizer 60 which can store a user's contact and calendar information. The organizer 60 can be used as a stand alone device, or in conjunction with device 16, which is shown as being a cellular telephone 62 in FIGS. 1, 12 and 13. As previously described, the housing 20 of the organizer 60 has a compact and light-weight size that enables it to be readily transported while taking up a minimum of space such as in a person's pocket or the like. As shown in FIG. 8A, the input keys or keypad 22 is asymmetrically arranged adjacent the side 40 of the LCD 12 at end portion 64 of the housing 20. The keys 22 allow a user to click through the calendar and address book functions of the organizer 60. The keys 22 have symbols thereon rather than letters or numbers so that a user can flip the organizer 60 over and still comfortably determine which keys 22 are to be utilized.

Figure 4:
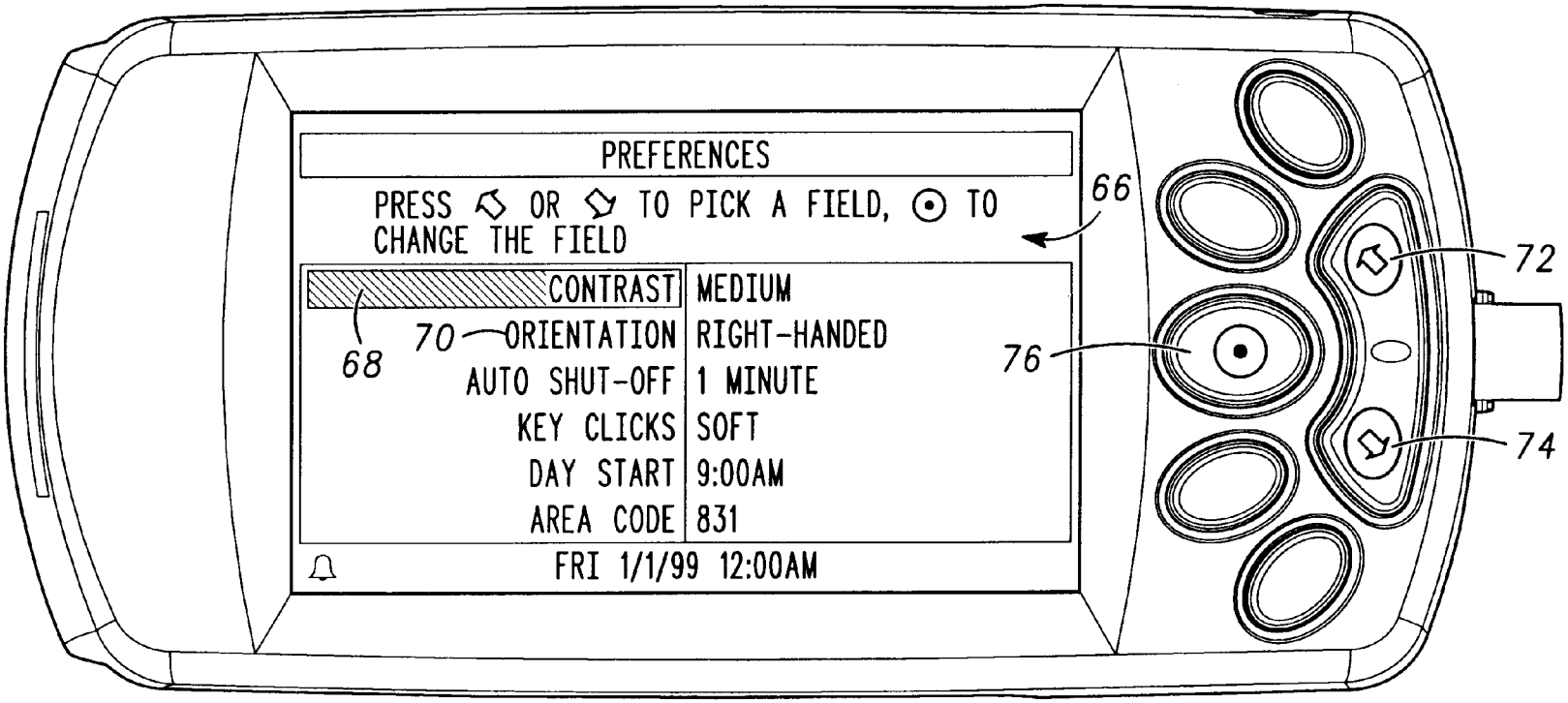
FIG. 4 is a view of the organizer showing a screen of the LCD that allows for adjustments to the contrast setting and the orientation of the characters which automatically adjusts the LCD viewing angle to maximize the visibility of the characters thereon when the character orientation is shifted.

FIG. 4 shows the preference screen 66 of the commercial organizer 60 of the assignee herein. As can be seen thereon, the preference screen 66 allows the user to select various modes including LCD contrast and screen orientation modes as shown in the left hand column of the preference screen 66, at 68 and 70, respectively. At the preferences screen 66, the arrow keys 72 and 74 allow the user to move between the various modes displayed thereon. When the desired mode is reached as indicated by highlighting thereof, the user presses the enter key 76 to enter the highlighted mode. Thereafter, the arrow keys 72 and 74 are used to move through the list of options that show up on the right-hand side of the preference screen 66 across from the selected mode, and when the desired option appears, it can be selected via enter key 76.

The preference screen 66 operates as a conventional scroll-down menu having multiple levels of selections. Implementation of the screen 66 using a programmable microprocessor and a commercially-available operating system supporting a graphical user interface (GUI) can be readily accomplished by one of ordinary skill in the art.

In the contrast mode 68, the user can change the contrast setting and thus the drive voltage, V, stored in the voltage memory 30 at which the LCD 12 is driven by the driver 28 to their preferences. Thereafter, this setting will be used to make the offset voltage determination when the screen flip switch is operated, as previously described. In the orientation mode 70, the user can select either the right-hand or left-hand orientation for the characters 14 on the screen 12 depending on their preferences. Further, when the screen orientation is selected by operating the keys 72–76 which together form the afore-described screen flip switch, the offset voltage determination is also made so that the viewing cone is switched for improving the visibility of the shifted characters 14 on the reoriented housing 20 and LCD 12 thereof.

Figure 9:
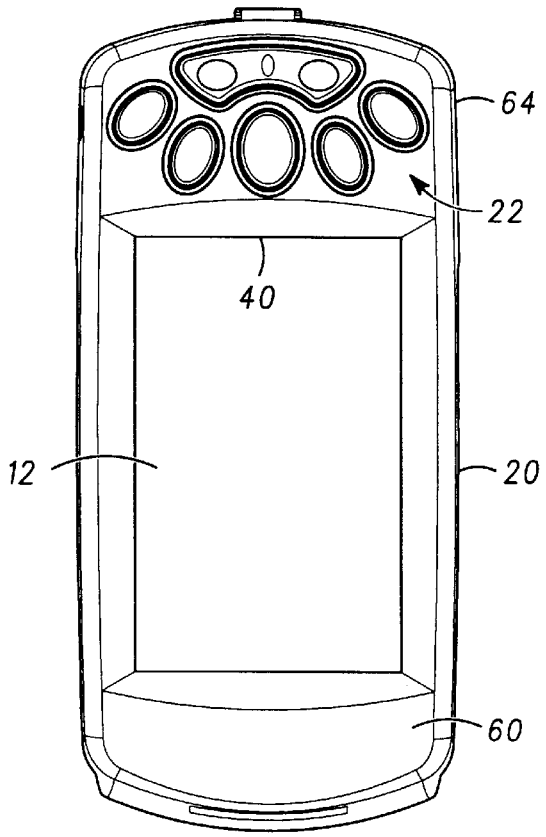
FIG. 9 is a plan view of the organizer detached from the cellular phone showing the keys on the right-hand side of the screen for use by a right-handed user.
Figure 10:
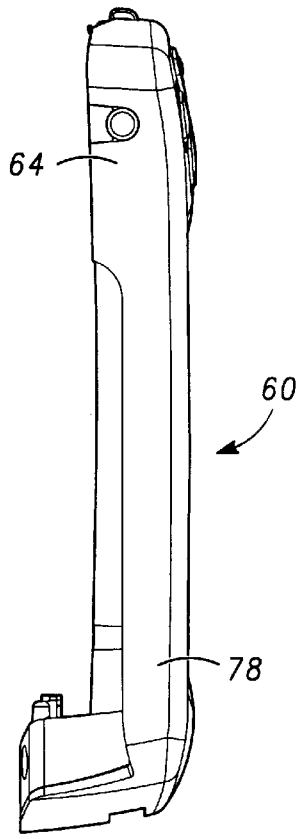
FIG. 10 is a side elevation view of the organizer of FIG. 9 showing a flanged end of the housing for being plugged into the cellular phone.
Figure 11:
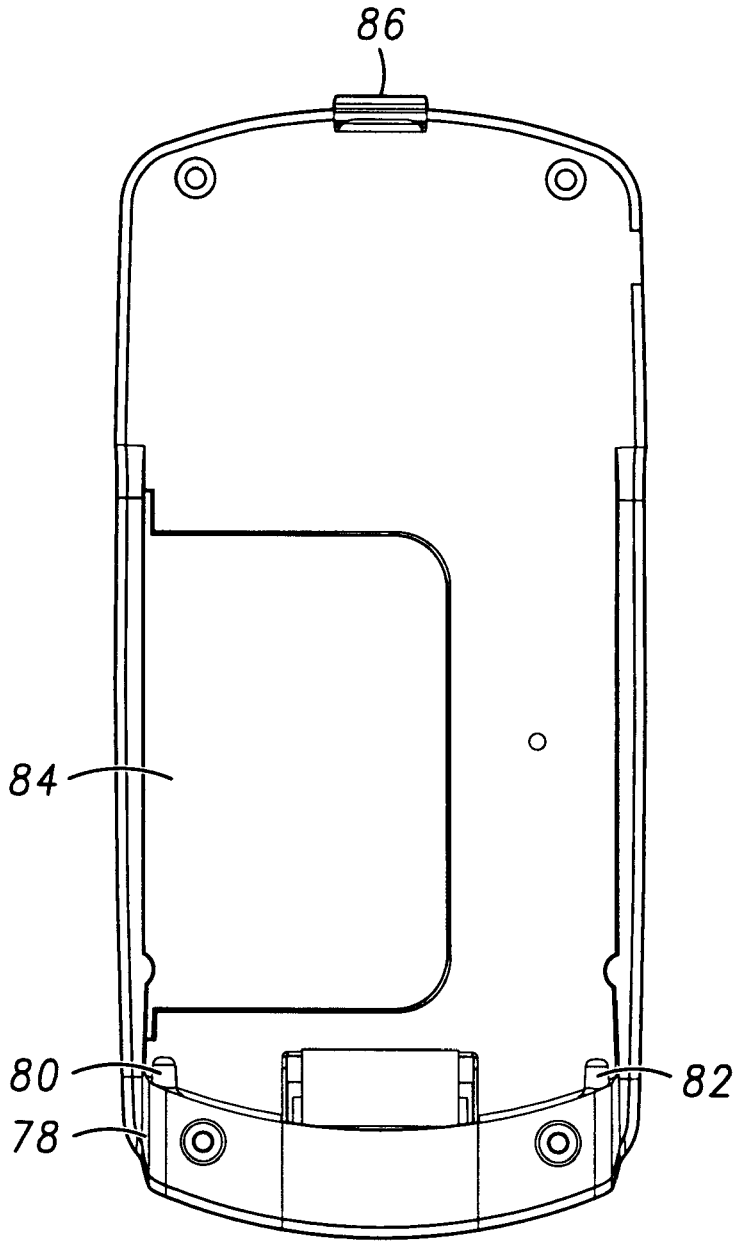
FIG. 11 is a bottom plan view of the organizer showing an electrical connector on the flanged end and a spring clip at the other end of the organizer.

As mentioned, the organizer 60 can be attached to and used with a cell phone 62 such as the assignees commercial StarTac® cell phone 62. For this purpose, the housing 20 of the organizer 60 has a flanged end portion 78 opposite end portion 64, as best seen in FIGS. 10 and 11. The flanged end portion 78 includes a pair of inwardly directed small prong members 80 and 82. Intermediate the members 80 and 82 is an electrical connector portion 84. A spring clip 86 is disposed opposite the electrical connector portion 84 on the bottom of the housing 20 at end portion 64 thereof. Referring to FIG. 9, the phone 62 is provided with small laterally spaced apertures 88 (one such aperture 88 being shown) and an accessory electrical connector portion (not shown) at one end thereof and a slotted opening 90 at the other end of the phone 62, with the opening 90 normally used to attach the auxiliary battery for the phone 62 thereto.

To attach the organizer 60 to the back of the cell phone 62, the spring clip 86 is inserted into the slotted opening 90 of the phone 62. The organizer 60 is then slid toward the opposite end of the phone in the direction of arrow 92 so that the prong members 80 and 82 can be inserted in the phone apertures 88 and the organizer electrical connector portion 84 can be plugged into the auxiliary electrical connector portion of the phone 62. The electrical connector portion 84 of the organizer 60 and the auxiliary electrical connector portion of the cellular telephone 62 together form the previously described detachable electrical connection 18.

With the organizer 60 electrically connected to the cell phone 62, phone numbers from the organizer 60 can be exported directly therefrom to the internal phone directory of the cell phone 62. The attached organizer 60 thus enables users to scroll through contact lists and, with the push of a key 22, automatically dial a phone number. In this manner, a user does not have to look up an entire phone number and then dial it as is normally the case.

Figure 13:
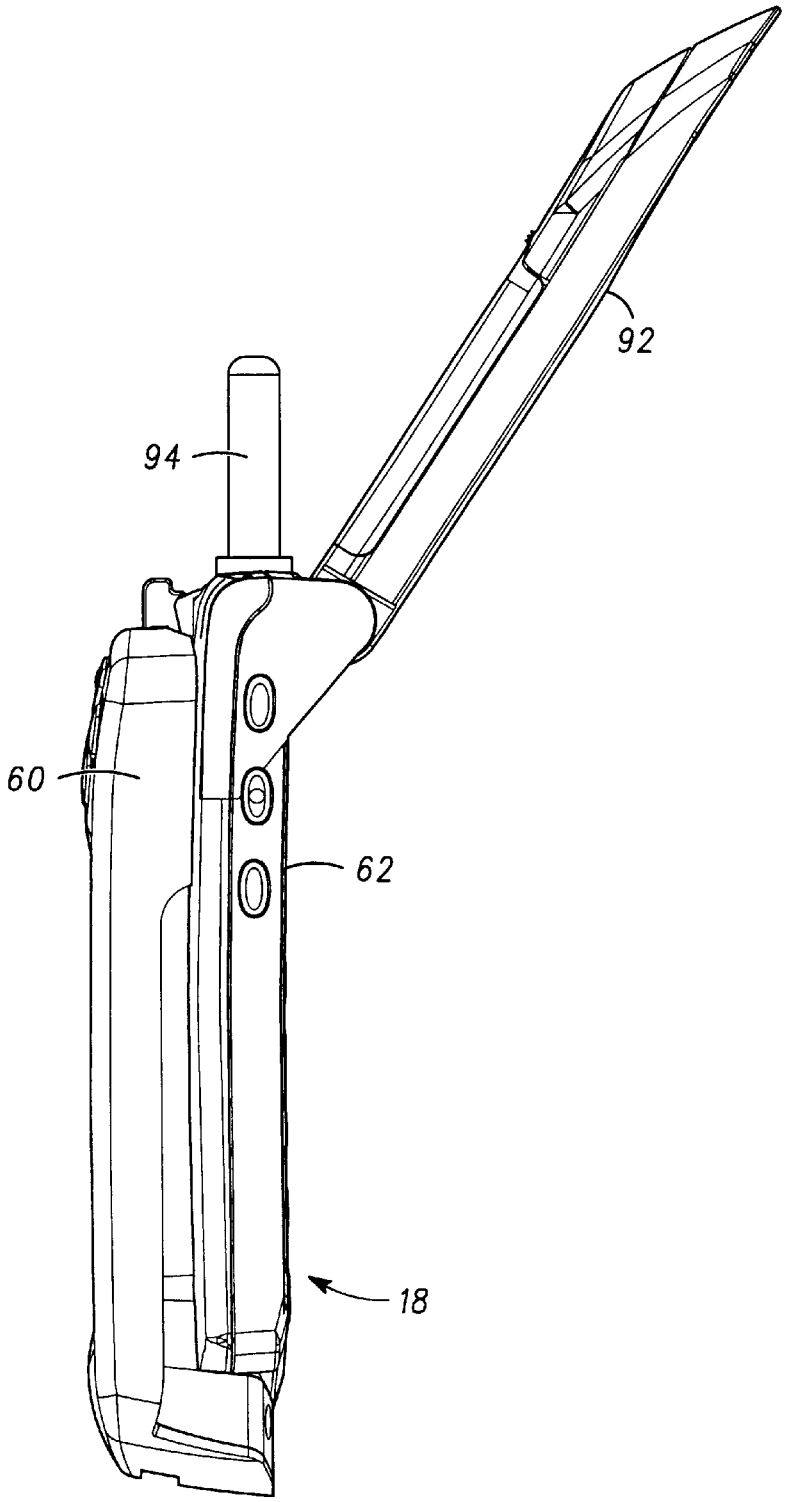
FIG. 13 is a side elevational view similar to FIG. 12 with the organizer removably attached to the phone and showing the phone flipped open for use.

Referring next to FIG. 13, the cell phone 62 includes a pivotal or flip open portion 92 thereof that includes a speaker for being placed next to a user's ear during a call. The phone 62 also includes a telescoping antenna 94. The present invention affords the user flexibility when the organizer 60 is clipped to the back of the cell phone 62 in that it is possible that with the phone portion 92 flipped open and the antenna 94 extended, it would be more convenient for the user to hold the attached organizer 60 and cell phone 62 when viewing the organizer LCD 12 in a hand that is different from the one they use when the organizer 60 is used alone. In this instance, the user can operate the screen flip switch 34 and the characters 14 on the screen 12 will remain at the preferred contrast setting that maximizes the visibility of the characters 14 to the user, as previously described.

While in the foregoing, there have been set forth preferred embodiments of the invention, it will be appreciated by those skilled in the art that the details herein given may be varied without departing from the true spirit and scope of the appended claims.

What is claimed is:

1. An apparatus comprising:

a display capable of being positioned in first and second orientations; and a controller, operatively coupled to the display, configured to control a function that provides output to the display and to change contrast of the output of the function from a first contrast level to a second contrast level in response to the display changing position from the first orientation to the second orientation; and a driver configured to provide to the display at least two contrast signals including a first contrast signal responsive to the display being positioned in the first orientation and a second contrast signal responsive to the display being positioned in the second orientation, the first contrast signal providing a contrast level on the display that is different from a contrast level provided on the display by the second contrast signal.

2. The apparatus of claim 1, further comprising a user interface for indicating an orientation of the display.

3. The apparatus of claim 1, wherein the controller determines each of the first and second contrast levels as a function of a user-selected contrast setting and an orientation of the display.

4. The apparatus of claim 3, wherein the controller is configured to receive the user-selected contrast setting for the first contrast level, and determine the user-selected contrast setting for the second contrast level based on the user-selected contrast setting for the first contrast level.

5. The apparatus of claim 1, wherein the first and second orientations differ by about 180 degrees.

6. The apparatus of claim 5, wherein the first orientation of the display permits one of either right-handed manipulation and left-handed manipulation of the output of the function whereas the second orientation of the display permits the other of either right-handed manipulation and left-handed manipulation of the output of the function.

* * * * *